United States Patent [19]

Pursell

[11] Patent Number: 4,585,201

[45] Date of Patent: Apr. 29, 1986

[54] CHRISTMAS TREE STAND

[76] Inventor: Richard A. Pursell, P.O. Box 321, Heber Springs, Ark. 72543

[21] Appl. No.: 633,249

[22] Filed: Jul. 23, 1984

[51] Int. Cl.[4] ..... F16M 13/00

[52] U.S. Cl. ..... 248/523; 248/524; 47/40.5

[58] Field of Search ..... 248/524, 523, 529, 519, 248/525, 526, 527, 528, 346; 47/40.5; 285/9 R

[56] References Cited

U.S. PATENT DOCUMENTS

| | | | |
|---|---|---|---|
| 646,364 | 3/1900 | Donnelly | 248/523 |
| 2,128,217 | 8/1938 | Anderson | 285/9 R |
| 2,485,081 | 10/1949 | Ahrens | 248/524 |
| 2,899,156 | 8/1959 | Marcucci | 248/524 |
| 3,038,688 | 6/1962 | Thorburn | 248/523 X |
| 3,272,462 | 9/1966 | Apple | 248/523 X |
| 3,353,773 | 11/1967 | Budd | 248/529 X |
| 3,820,749 | 6/1974 | Leonard et al. | 248/523 X |

*Primary Examiner*—Ramon S. Britts
*Assistant Examiner*—David M. Purol
*Attorney, Agent, or Firm*—Harvey B. Jacobson; Clarence A. O'Brien

[57] ABSTRACT

An upwardly opening shallow tray is provided constructed of shape retentive and at least somewhat deformably resilient material. The tray includes a bottom wall and upstanding peripheral walls extending about and projecting upwardly from the outer periphery of the bottom wall. An upright post is also provided including upper and lower end portions and the lower end portion is diametrically enlarged and includes a generally planar under surface downwardly abutted against the central area of the upper surface of the bottom. The post under surface includes a plurality of generally concentric and circular sealing ridges of different diameters projecting slightly downwardly therefrom forcibly, downwardly and sealingly seated against and deforming opposing portions of the upper surface of the bottom wall to form a fluid-tight seal therewith. An elongated headed and threaded shank-type fastener is secured upwardly through the central area of the bottom wall and is removably threadedly engaged in a downwardly opening threaded bore provided in the lower end portion of the post. The upper end portion of the post may be snugly received in a central downwardly opening blind bore formed in the base end of the trunk of a cut tree to be supported within the tray and the post includes upwardly facing and outwardly projecting abutment surfaces disposed at an elevation above the upper surface of the bottom wall and below the lowest upper marginal portion of the peripheral wall for abutting with the lower end of the tree trunk about the bore formed therein.

8 Claims, 5 Drawing Figures

10
12
58
2
44
2
46
16
42

24
22
28
26
36
38
40

10
24
56
12
14
58
16
30
20
28
52
26
32
40
18
42
46
36
34
38
44

10
12
44
42
48
46
50
52

122
124
128
130
126
134
132

CHRISTMAS TREE STAND

BACKGROUND OF THE INVENTION

When erecting cut trees such as Christmas trees and specimen trees for display purposes, tree stands for gripping and supporting the base ends of the tree trunks are used. In addition, many different forms of such tree stands have incorporated therein pan areas in which water may be placed to extend the display life of associated trees. However, such stands represent a considerable expense and often are not of a construction providing ample support against tipping of the tree on display.

Many tree stands are constructed of metal and include three or four legs, but such leg-equipped metal stands include legs which are actually quite flexive and offer little resistance to the associated trees being initially angularly displaced from upright positions with the result that the center of gravity of a display tree may be disposed considerably off-center before the legs of the tree stand begin to offer reasonable resistance to further tilting of the tree. However, after such initial tilting of a tree is allowed and the center of gravity of the tree is considerably laterally displaced off-center, the tendency of the tree to further tilt is increased and most tree stands do not include a sufficiently large area supportive base to effectively resist such further tilting of a reasonably heavy tree. Accordingly, a need exists for an improved form of tree stand including structure by which the lower end of the tree trunk may be provided with suitable water and the tree trunk may be adequately braced against initial inclining from an upright position.

Various different forms of tree stands including some of the general structural and operational features of the instant invention are disclosed in U.S. Pat. Nos. 934,424, 2,534,349, 2,905,414, 3,191,266 and 3,142,464. However, these previously known forms of tree stands do not incorporate the combined structural features of the instant invention for the purpose of not only supporting a tree in a rigid manner against initial lateral deflection from an upright position but also in a manner providing ample water for the lower end of the trunk of the tree.

BRIEF DESCRIPTION OF THE INVENTION

The tree stand of the instant invention incorporates an upwardly opening pan in which water may be received and an upstanding shank assembly rigidly anchored relative to the upper surface of the bottom of the pan and adapted to be telescoped within a downwardly opening blind bore formed in the lower end of the trunk of an associated tree. The shank assembly is anchored to the central area of the bottom of the pan by a threaded fastener secured upwardly through the pan bottom and into the lower end of the shank assembly. Further, the threaded fastener is also secured upwardly through a wooden tree stand of the type including crossed horizontal arms and one end of each arm is also braced relative to the tree trunk by a diagonal brace. In this manner, an extremely rigid connection is provided between the crossed arms of the wooden tree stand and the tree trunk to be supported therefrom.

The main object of this invention is to provide a tree stand which will be capable of offering considerable resistance to initial inclination of a supported tree and yet including structure whereby the cut lower end of the trunk of the tree may be provided with ample water.

Another object of this invention is to provide a tree stand in accordance with the preceding object and which may be used repeatedly by the owner of the tree stand each year for supporting a Christmas tree in upright position.

Another very important object of this invention is to provide a tree stand which will need no adjustment to compensate for differences in the diameter of successive tree trunks to be supported therefrom.

A final object of this invention to be specifically enumerated herein is to provide a tree stand in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
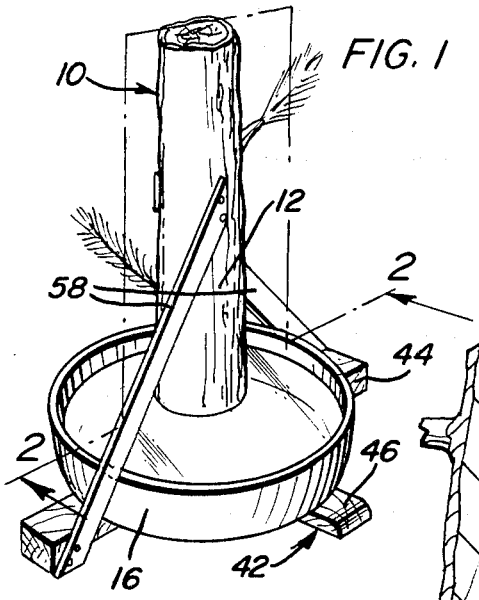
FIG. 1 is a perspective view of the tree stand of the instant invention with the lower end a supported tree trunk operatively associated therewith.
Figure 3:
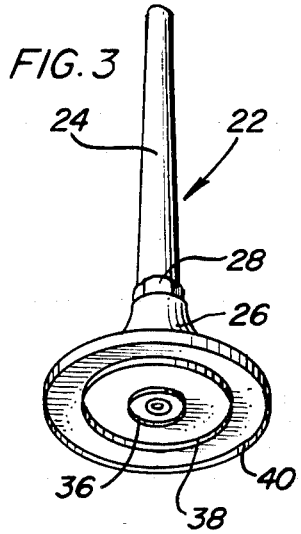
FIG. 3 is a perspective view of the shank assembly portion of the tree stand.
Figure 2:
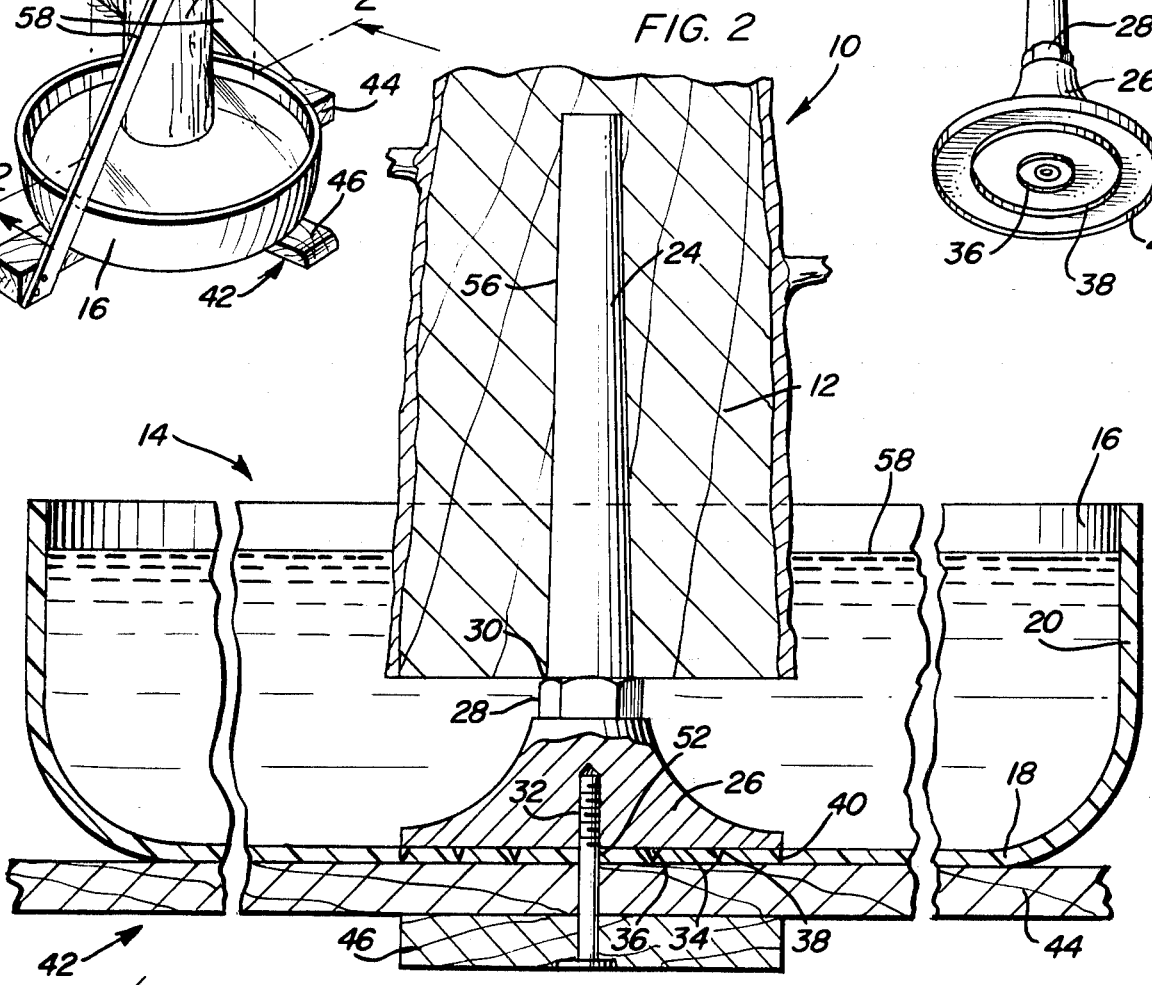
FIG. 2 is an enlarged fragmentary vertical sectional view taken substantially upon the plane indicated by the section line 2—2 of FIG. 1.
Figure 4:
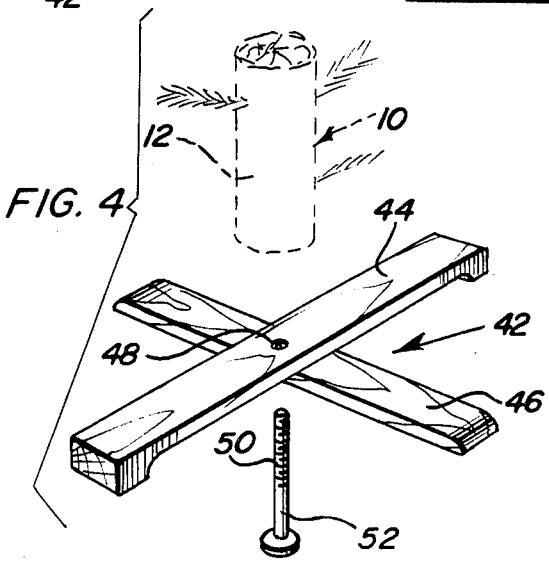
FIG. 4 is a perspective view of the crossed arm wooden base of the tree stand.

Referring now more specifically to the drawings the numeral 10 generally designates a Christmas tree including a trunk lower end portion 12. The tree stand of the instant invention is referred to in general by the reference numeral 14.

The stand 14 includes an upwardly opening generally circular pan 16 including a bottom wall 18 and an upstanding peripheral wall 20 extending about and projecting upwardly from the outer periphery of the bottom wall 18. The pan 16 may be constructed of any suitable material such as heavy gauge metal or plastic.

The tree stand 14 also includes a shank or post assembly referred to in general by the reference numeral 22 and the assembly 22 includes an upwardly tapering upper end portion 24, a diametrically enlarged lower end portion 26 and on intermediate portion 28. The intermediate portion 28 forms an upwardly facing annular shoulder 30 extending peripherally thereabout at the lower end of the upper end portion 24. Further, the intermediate portion 28 is non-circular in horizontal cross section in order that a suitable wrench (not shown) may be engaged therewith in order to retain the intermediate portion 28 against rotation.

The lower end portion 26 includes a central downwardly opening blind threaded bore 32 formed therein and defines a generally planar undersurface 34 through which the bore 32 opens. Further, the undersurface 34 includes a plurality of generally concentric and circular sealing ridges 36, 38 and 40 which project downwardly therefrom.

The stand 14 additionally includes a conventional base referred to in general by the reference numeral 42 and comprising a pair of crossed horizontal arms 44 and 46, the arm 46 being cut from the lower marginal portion of the arm 44. The arms 44 and 46 are crossed and provided with registered bores 48 formed therein upwardly through which the threaded shank portion 50 of a headed fastener 52 is receivable. In addition, the central area of the bottom wall 18 includes a central bore 52 formed therethrough upwardly through which the shank portion 50 is also receivable.

Upon assembling the tree stand 14, the shank or post assembly 22 is centered over the bottom wall 18 and the shank portion 50 of the fastener 52 is passed upwardly through the bores 48 and 52 and threadedly engaged in the threaded blind bore 32. In this manner, the bottom wall 18 is tightly clamped between the lower end portion 26 of the shank or post assembly 22 and the arm 44 of the base 42. As the bottom wall 18 is tightly clamped between the lower end portion 26 and the arm 44, the ridges 36, 38 and 40 bit into and indent the bottom wall 18 and/or are flattened thereby about the bore 52 forming a fluid-tight seal between the lower end portion 26 and the upper surface of the bottom wall 18.

After the support or post assembly 22, pan 16 and base 42 have thus been assembled, the trunk lower end portion 12 may have a tapered blind bore 56 formed therein in which the tapered upper end portion 24 is snugly receivable. Thereafter, inclined braces 58 constructed of wood or other suitable materials are nailed between at least two of the ends of the arms of the base 42 and the trunk lower end portion 12. In this manner, a secure attachment of the trunk lower end portion 12 to the tree stand 14 is afforded to strongly resist even initial deviation of the tree 10 from an upright position. Of course, after the tree 10 has been supported from the tree stand 14 and disposed in an upright position, a suitable quantity of water 58 may be placed within the pan 16.

It is believed that it will be readily appreciated that the conventional base 42 is quite inexpensive to purchase and that the pan 16 will also be inexpensive to purchase. Further, the shank or post assembly 22 may itself be constructed of plastic material and thus also be inexpensive to purchase.

Figure 5:
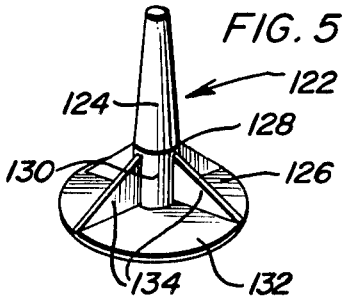
FIG. 5 is a perspective view of a modified form of shank assembly.

With attention now invited to FIG. 5, there may be seen a modified form of shank or post assembly generally designated by the reference numeral 122. The assembly 122 includes upper, lower and intermediate portions 124, 126 and 128 and the portion 124 is identical to portion 24 and the portion 126 includes a cylindrical core 130, a lower terminal end circular base plate portion 132 secured to or formed integrally with the lower end of the core 130 and generally radial gusset plates 134 extending between the upper surface of the base plate portion 132 and the core 130. The intermediate portion 128 comprises the juncture between the upper end portion 124 and the core 130 and the gusset plates 134 include upper surface portions disposed immediately adjacent the core 130 defining abutment surface portions engageable by the lower end of the trunk lower end portion 12 to limit penetration of the upper end portion 124 into the bore 56. Further, the gusset plates 134 serve as a handgrip during tightening of the fastener 52, whereas the circular plan shape of the lower end portion 26 requires the non-circular intermediate portion 28 with which a wrench 28 may be engaged.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A Christmas tree stand including an upwardly opening shallow tray constructed of shape-retentative and at least somewhat deformably resilient material, said tray including bottom wall means having an outer periphery, a central area spaced inward of said outer periphery and upper and lower surfaces, said bottom wall including upstanding peripheral wall means extending about and projecting upwardly from the outer periphery of said bottom wall means, an upright post including upper and lower end portions, said lower end portion being diametrically enlarged, of a material harder than that of said tray and including a generally planar undersurface downwardly abutted against said central area of the upper surface of said bottom means, said undersurface including a plurality of generally concentric circular sealing ridges of different diameters projecting slightly downwardly therefrom and forcibly downwardly sealingly seated against and deforming opposing portions of said bottom wall means, elongated headed and threaded shank-type fastener means secured upwardly through said central area and removably threadedly engaged in a suitable downwardly opening threaded bore provided therefor in said lower end portion, the upper end portion of said post projecting upwardly to a level appreciably above said peripheral wall means and being adapted to be upwardly telescoped into a compatible downwardly opening central blind bore formed in the base end of the trunk of a cut tree to be supported from said stand, said post including upwardly facing and outwardly projecting abutment surface means disposed at an elevation above said upper surface and below the upper marginal portion of said peripheral wall means and adapted to be abutted by the portions of said base end disposed about said bore for limiting downward movement of said trank relative to said post, a cross brace-type of base underlying said tray and upwardly through the center of which said fastener means is secured, said cross brace-type of base including a generally planar central area upper surface portion backing the lower surface of said bottom wall means central area from therebeneath.

2. The tree stand of claim 1 wherein said sealing ridges equal at least three in number.

3. The tree stand of claim 1 wherein said upper end portion of said post is slightly upwardly tapered.

4. The tree stand of claim 1 wherein said lower end portion is circular in horizontal plan substantially throughout the vertical extent thereof.

5. The tree stand of claim 1 wherein said lower end portion includes a substantially cylindrical core having peripherally spaced outer surface portions and terminating downwardly in an enlarged diameter base plate portion disposed normal to the center axis of said core and with which said core is generally centered, and a plurality of peripherally spaced generally radially extending gusset plates secured to and extending between selected outer surface portions of said core and selected areas of said base plate portion disposed outwardly of said core, said gusset plates including upper portions thereof adjacent said core defining said abutment surface means.

6. The tree stand of claim 1 including a cross brace-type of base underlying said tray and upwardly through the center of which said fastener means is secured, said cross brace-type of base including crossed arm members, and inclined brace members having upper and lower ends and their lower ends anchored relative to at least two ends of said arm members, the upper ends of said brace members being upwardly convergent for anchoring, as by nails, to adjacent portions of an associated tree trunk lower end portion.

7. The tree stand of claim 6 wherein said sealing ridges equal at least three in number.

8. The tree stand of claim 7 wherein said upper end portion of said post is slightly upwardly tapered.

* * * * *